US007570243B2

(12) United States Patent
Kang et al.

(10) Patent No.: US 7,570,243 B2
(45) Date of Patent: Aug. 4, 2009

(54) LIQUID CRYSTAL DISPLAY AND DRIVING METHOD THEREOF

(75) Inventors: Sin Ho Kang, Suwon-si (KR); Jin Cheol Hong, Gumi-si (KR); Sung Chul Ha, Gyeongsangbuk-do (KR)

(73) Assignee: LG. Display Co., Ltd., Seoul (KR)

( * ) Notice: Subject to any disclaimer, the term of this patent is extended or adjusted under 35 U.S.C. 154(b) by 675 days.

(21) Appl. No.: 11/295,975

(22) Filed: Dec. 6, 2005

(65) Prior Publication Data

US 2006/0290637 A1 Dec. 28, 2006

(30) Foreign Application Priority Data

Jun. 28, 2005 (KR) ..... 10-2005-0056544

(51) Int. Cl.
*G09G 3/36* (2006.01)

(52) U.S. Cl. ..... 345/98; 345/87

(58) Field of Classification Search ..... 345/87–100
See application file for complete search history.

(56) References Cited

U.S. PATENT DOCUMENTS

| | | | | |
|---|---|---|---|---|
| 5,363,118 | A * | 11/1994 | Okumura | 345/95 |
| 5,892,493 | A * | 4/1999 | Enami et al. | 345/94 |
| 2002/0047820 | A1 * | 4/2002 | Ha | 345/87 |
| 2002/0118154 | A1 * | 8/2002 | Kim | 345/87 |
| 2004/0263466 | A1 * | 12/2004 | Song et al. | 345/100 |

* cited by examiner

*Primary Examiner*—Richard Hjerpe
*Assistant Examiner*—Carolyn R Edwards
(74) *Attorney, Agent, or Firm*—Brinks Hofer Gilson & Lione

(57) ABSTRACT

A liquid crystal display device includes a first transistor that outputs a charge share voltage to a data line in response to a first output control signal. A second transistor outputs a pre-charge voltage, which is greater than the charge share voltage, to the data line in response to a second output control signal which is delayed in phase from the first output control signal. A third transistor outputs a data voltage to the data line in response to at least one of the first and second output control signals. A logic circuit controls the transistors in response to the output control signals and a polarity control signal that controls the polarity of the data voltage.

13 Claims, 8 Drawing Sheets

LIQUID CRYSTAL DISPLAY AND DRIVING METHOD THEREOF

This application claims the benefit of the Korean Patent Application No. P2005-56544 filed on Jun. 28, 2005, which is hereby incorporated by reference.

BACKGROUND

1. Field

The present embodiments relate, generally, to liquid crystal display devices, and more particularly, to a liquid crystal display device configured for lowering a generated heat temperature of a data integrated circuit and reducing power consumption, and a driving method thereof.

2. Description of the Related Art

A liquid crystal display device controls a light transmittance of liquid crystal cells in accordance with a video signal, thereby displaying a picture.

An active matrix type liquid crystal display device can actively control a switching device, thereby advantageously realizing a motion picture. A thin film transistor (hereinafter, referred to as "TFT") is typically used as a switching device in the active matrix type liquid crystal display device.

Referring to FIG. 1, the liquid crystal display device includes a liquid crystal display panel 2 where a plurality of data lines 5 and a plurality of gate lines 6 cross each other and TFT's (not shown) are respectively formed at the crossing parts thereof for driving liquid crystal cells; a data driver 3 for supplying data to the data lines 5; a gate driver 4 for supplying scan pulses to the gate lines 6; and a timing controller 1 for controlling the data driver 3 and the gate driver 4.

The liquid crystal display panel 2 has a liquid crystal injected between two glass substrates (not shown), and has data lines 5 and gate lines 6 cross each other on the lower of the two glass substrate. A TFT formed at a crossing part of a corresponding data line 5 and a corresponding gate line 6 supplies a data signal from the data line 5 to a liquid crystal cell in response to a scan pulse from the gate line 6. As such, a gate electrode (not shown) of the TFT is connected to the gate line 6, and a source electrode (not shown) is connected to the data line 5. Moreover, a drain electrode (not shown) of the TFT is connected to a pixel electrode of the liquid crystal cell Clc. Further, a storage capacitor Cst (not shown) is formed on the lower glass substrate of the liquid crystal display panel 2 for sustaining a voltage of the liquid crystal cell.

The timing controller 1 receives a digital video data signal RGB from a system or unit (not shown), a horizontal synchronization signal (H), a vertical synchronization signal (V) and a clock signal CLK to generate a gate control signal GDC for controlling the gate driver 4 and to generate a data control signal DDC for controlling the data driver 3. Further, the timing controller 1 supplies the received data RGB signal to the data driver 3. The data control signal DDC includes a source shift clock SSC, a source start pulse SSP, a polarity control signal POL, and a source output enable signal SOE to be supplied to the data driver 3. The gate control signal GDC includes a gate start pulse GSP, a gate shift clock GSC, and a gate output enable GOE to be supplied to the gate driver 4.

The gate driver 4 includes a shift register which sequentially generates a scan pulse in response to the gate control signal GDC from the timing controller 1; a level shifter for shifting a swing width of the scan pulse to a level which is suitable for driving the liquid crystal cell Clc; and an output buffer. The gate driver 4 supplies the scan pulse to the gate line 6 to turn on (control) the TFT connected to the gate line 6, thereby selecting liquid crystal cells Clc of one horizontal line to which a pixel voltage of data, i.e., an analog gamma compensation voltage, is to be supplied. The data generated from the data driver 3 are supplied to the liquid crystal cells Clc of the horizontal line which is selected by the scan pulse.

The data driver 3 supplies the data to the data lines 5 in response to the data drive control signal DDC supplied from the timing controller 1. The data driver 3 samples the digital data RGB from the timing controller 1, latches the data, and then converts the data into an analog gamma voltage. The data driver 3 comprises a plurality of data integrated circuits (hereinafter, referred to as "IC") 3A having a configuration as shown in FIG. 2.

Each of the data IC's 3A, as shown in FIG. 2, includes a data register 21 to which the digital data RGB is inputted from the timing controller 1; a shift register 22 for generating a sampling clock; a first latch 23, a second latch 24, a digital/analog converter (hereinafter, referred to as "DAC") and an output circuit 26 which are connected between the shift register 22, and k (with 'k' being an integer less than 'm') number of data lines DL1 to DLk; and a gamma voltage supplier 27.

The data register 21 supplies the digital data RGB from the timing controller 1 to the first latch 23. The shift register 22 shifts the source start pulse SSP from the timing controller 1 in accordance with the source sampling clock signal SSC to generate the sampling signal. Further, the shift register 22 shifts the source start pulse SSP to transmit a carry signal CAR from the shift register 22 to the next step of the IC 3A. The first latch 23 sequentially samples the digital data RGB received from the data register 21 in response to the sampling signal which is sequentially inputted from the shift register 22. The second latch 24 latches the data inputted from the first latch 23, and then simultaneously outputs the latched data in response to the source output enable signal SOE received from the timing controller 1. The DAC 25 converts the data from the second latch 24 and the gamma voltages DGH, DGL from the gamma voltage supplier 27. The gamma voltages DGH, DGL are analog voltages which correspond to each of two gray levels of the digital input data. The output circuit 26 includes an output buffer connected to each of the data lines. The gamma voltage supplier 27 subdivides a gamma reference voltage to supply the gamma voltage corresponding to each gray level to the DAC 25.

The data IC 3A incurs an increased load and an increased driving frequency as the liquid crystal display device is configured to be of a relatively larger size and to have a substantially high precision, thereby increasing a generated heat. Due to the generated heat of the data IC 3A, the driving reliability of the data IC 3A is decreased and the operable safety may be dangerously compromised, e.g., a fire may occur. A substantial contributing source for generating heat in the data IC 3A is an output buffer 26A, shown in FIG. 3. That is, the data IC 3A generates heat by the power consumption due to currents Isource, and iSINK flowing through corresponding internal resistant components of the output buffer 26A.

In order to improve a charge characteristic of the liquid crystal cell and to reduce power consumption, the data IC is trendily operably configured using a charge share method or a pre-charge method. In the charge share method, the data voltage is supplied to each data line while the data lines are separated after connecting the adjacent data lines and pre-charging the data line with a charge voltage which is generated due to a charge share between the data lines. In the pre-charge method, the data voltage is supplied to the data line after pre-charging the data line with the pre-charge voltage which is a pre-set external voltage.

In the charge share method, as shown in FIG. 4, a relatively large amount of current flows in the output buffer 26A, namely in an output buffer driving section, when the charge share voltage Vshare is changed or switched to the data voltage, thereby substantially increasing the generated heat and power consumption. In the pre-charge method, as shown in FIG. 5, the voltage of a driving area of the output buffer 26A is reduced, to lower the temperature of the data IC 3A, to the pre-charge voltages +Vpre and −Vpre supplied from a white or grid voltage of a relatively high external voltage initially provided to the data IC 3A when the data voltage is relatively higher. However, the temperature of the data IC 3A is increased and its power consumption is rapidly increased in the pre-charge driving area 51, 52 of a low data voltage due to the pre-charge voltages +Vpre, and −Vpre, which are supplied from the relatively high external voltage, in a data voltage which is below a middle point of the high external voltage.

SUMMARY

The present invention is defined by the appended claims. This description summarizes some aspects of the present embodiments and should not be used to limit the claims.

A liquid crystal display device and a method for driving the same are provided for lowering a generated heat temperature of a data integrated circuit and reducing power consumption.

In one aspect, a liquid crystal display device includes a first transistor that outputs a charge share voltage to a data line in response to a first output control signal. A second transistor outputs a pre-charge voltage, which is higher than the charge share voltage, to the data line in response to a second output control signal which is delayed in phase relative to the first output control signal. A third transistor outputs a data voltage to the data line in response to at least one of the first and second output control signals. A logic circuit controls the transistors in response to the output control signals and a polarity control signal controls the polarity of the data voltage.

In another aspect, a driving method of a liquid crystal display device includes the steps of out putting a charge share voltage to a data line in response to a first output control signal. In the proposed method, a pre-charge voltage, which is greater than the charge share voltage, is outputted or supplied to the data line in response to a second output control signal which is delayed in phase relative to the first output control signal. Further, a data voltage is supplied to the data line in response to at least one of the first and second output control signals.

It is to be understood that both the foregoing general description and the following detailed description of the present embodiments are exemplary and explanatory and are intended to provide further explanation of the invention as claimed.

BRIEF DESCRIPTION OF THE DRAWINGS

The accompanying drawings, which are included to provide a further understanding of the present embodiments and are incorporated in and constitute a part of this application, illustrate the present embodiment(s) and together with the description serve to explain the present embodiment(s). In the drawings.

DETAILED DESCRIPTION OF THE DRAWINGS

Reference will now be made in detail to embodiments of the present invention, examples of which are illustrated in the accompanying drawings.

Figure 1:
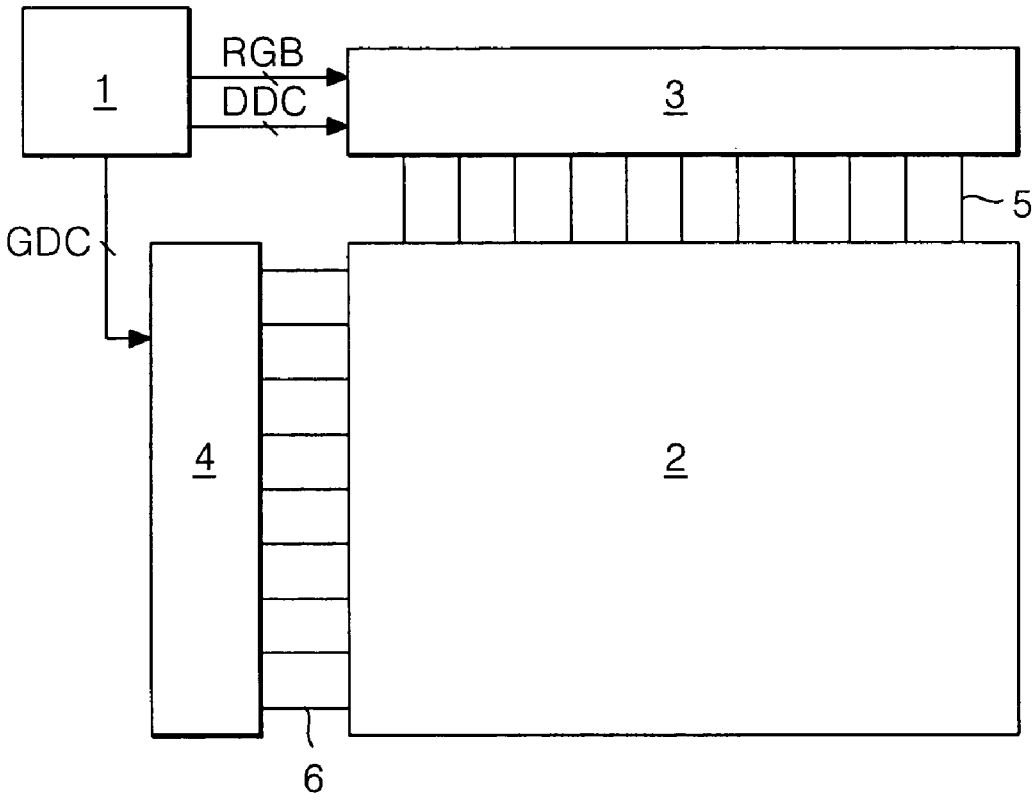
FIG. 1 RELATED ART
FIG. 1 is a block diagram schematically illustrating a liquid crystal display device.
Figure 2:
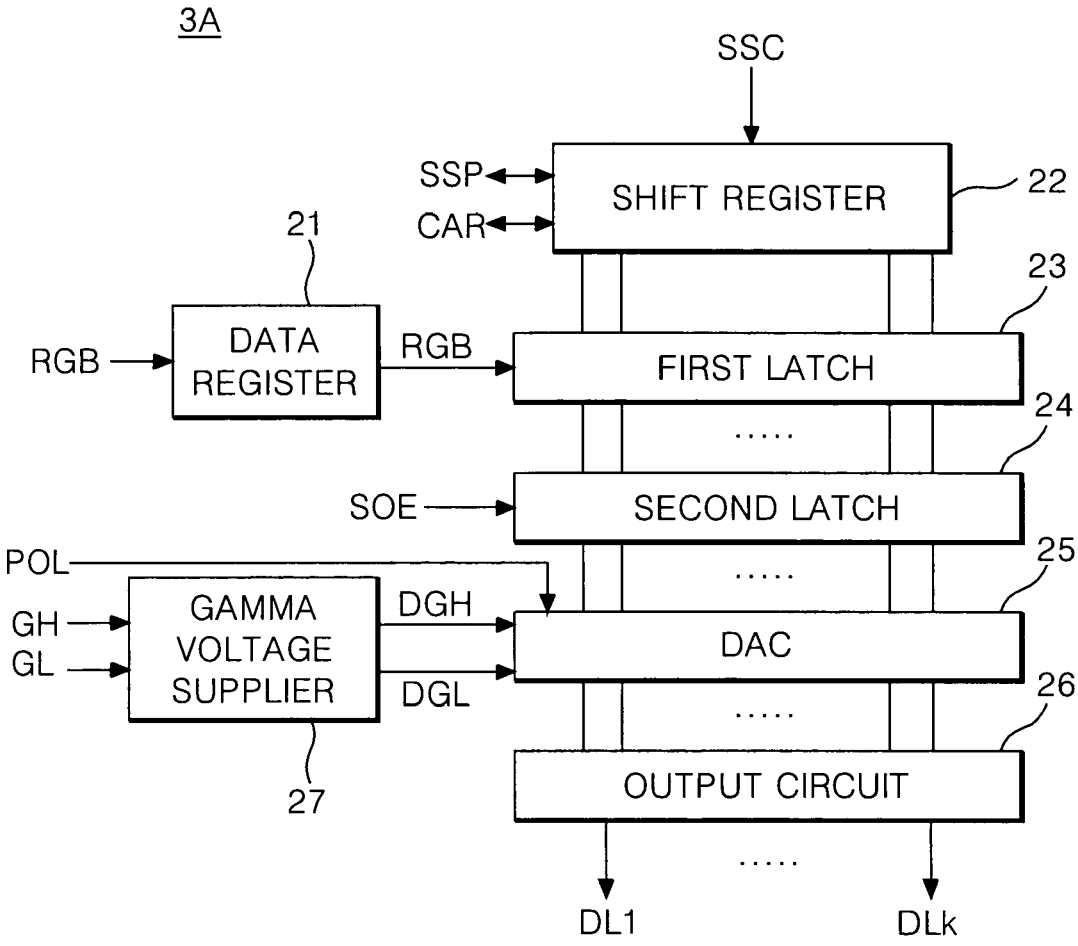
FIG. 2 RELATED ART
FIG. 2 is a block diagram illustrating a data driver shown in FIG. 1.
Figure 3:
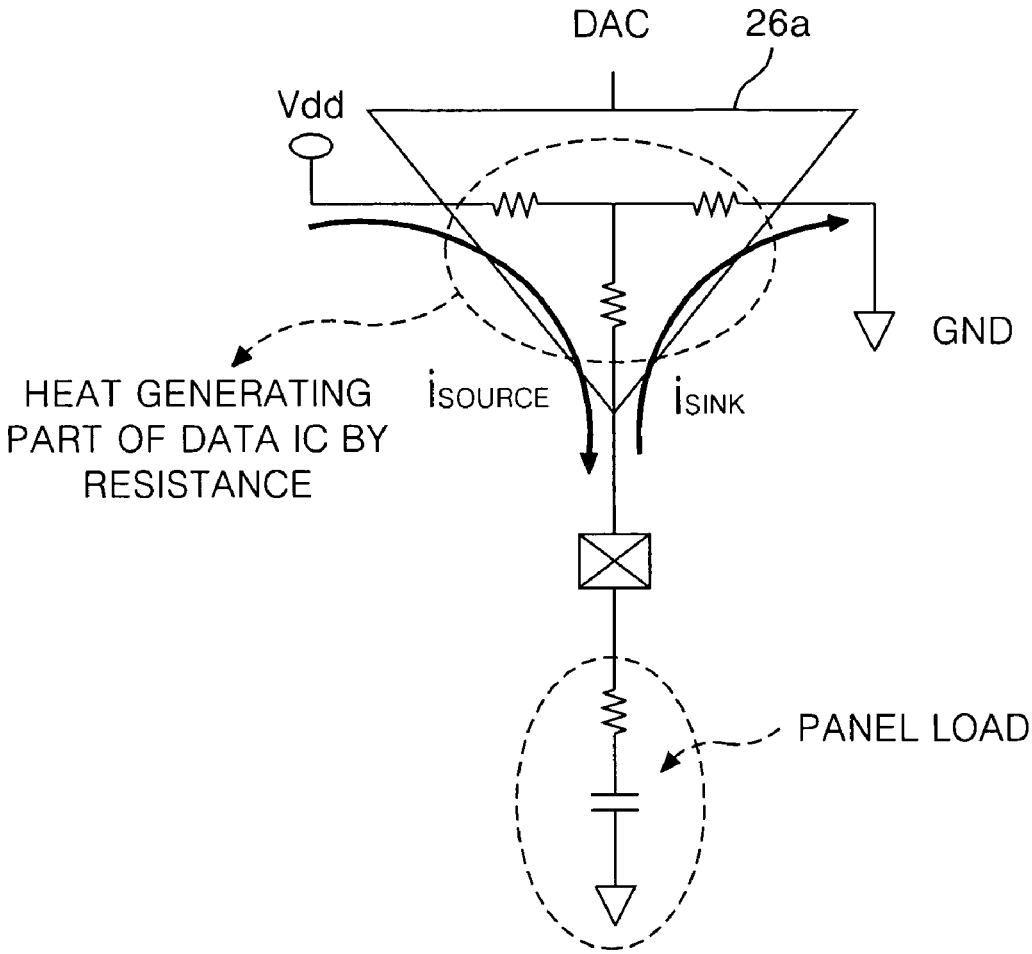
FIG. 3 RELATED ART
FIG. 3 is a circuit diagram illustrating an internal resistor within an output buffer of the data driver of FIG. 2, and currents flowing through the internal resistor.
Figure 4:
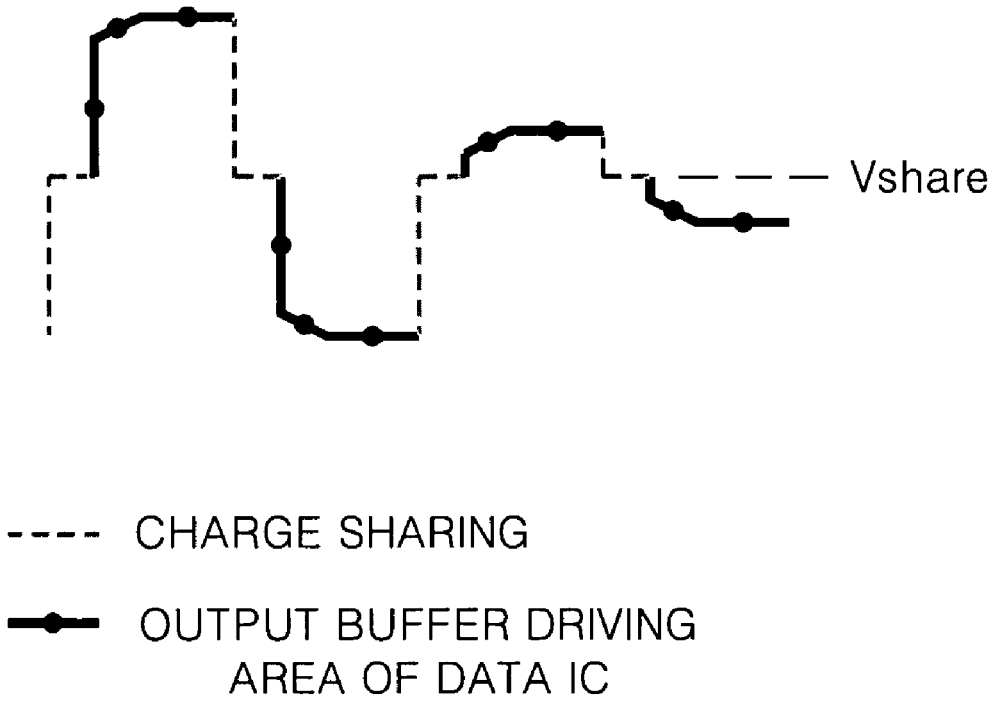
FIG. 4 RELATED ART
FIG. 4 is a waveform diagram corresponding to one embodiment in which a data line is pre-charged with an external pre-charge voltage.
Figure 5:
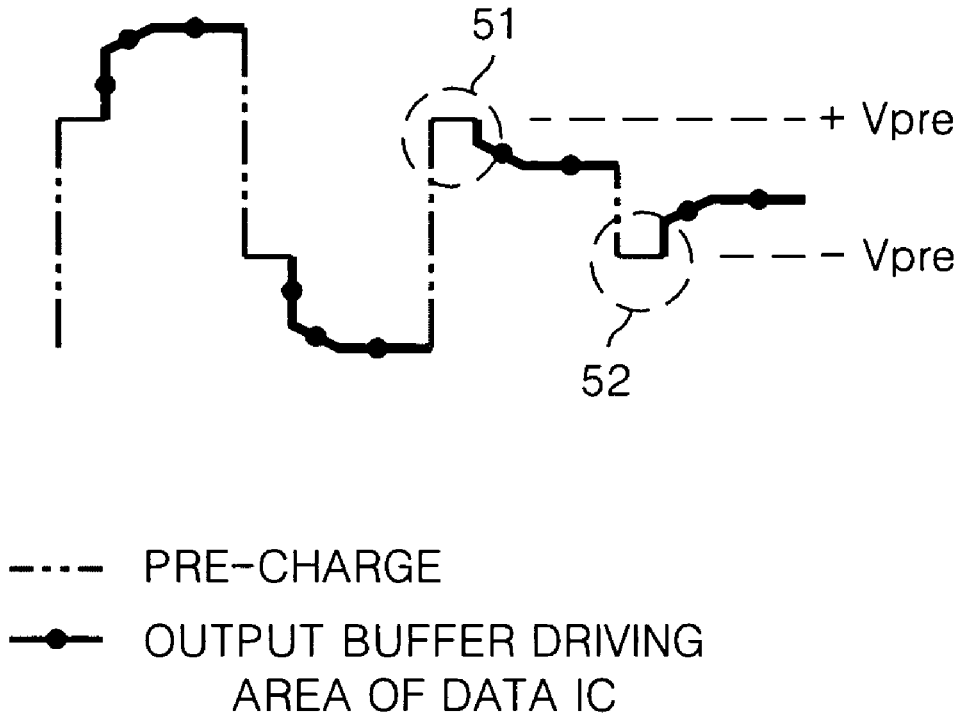
FIG. 5 RELATED ART
FIG. 5 is a waveform diagram corresponding to another embodiment in which a data line is pre-charged with a charge share voltage.
Figure 6:
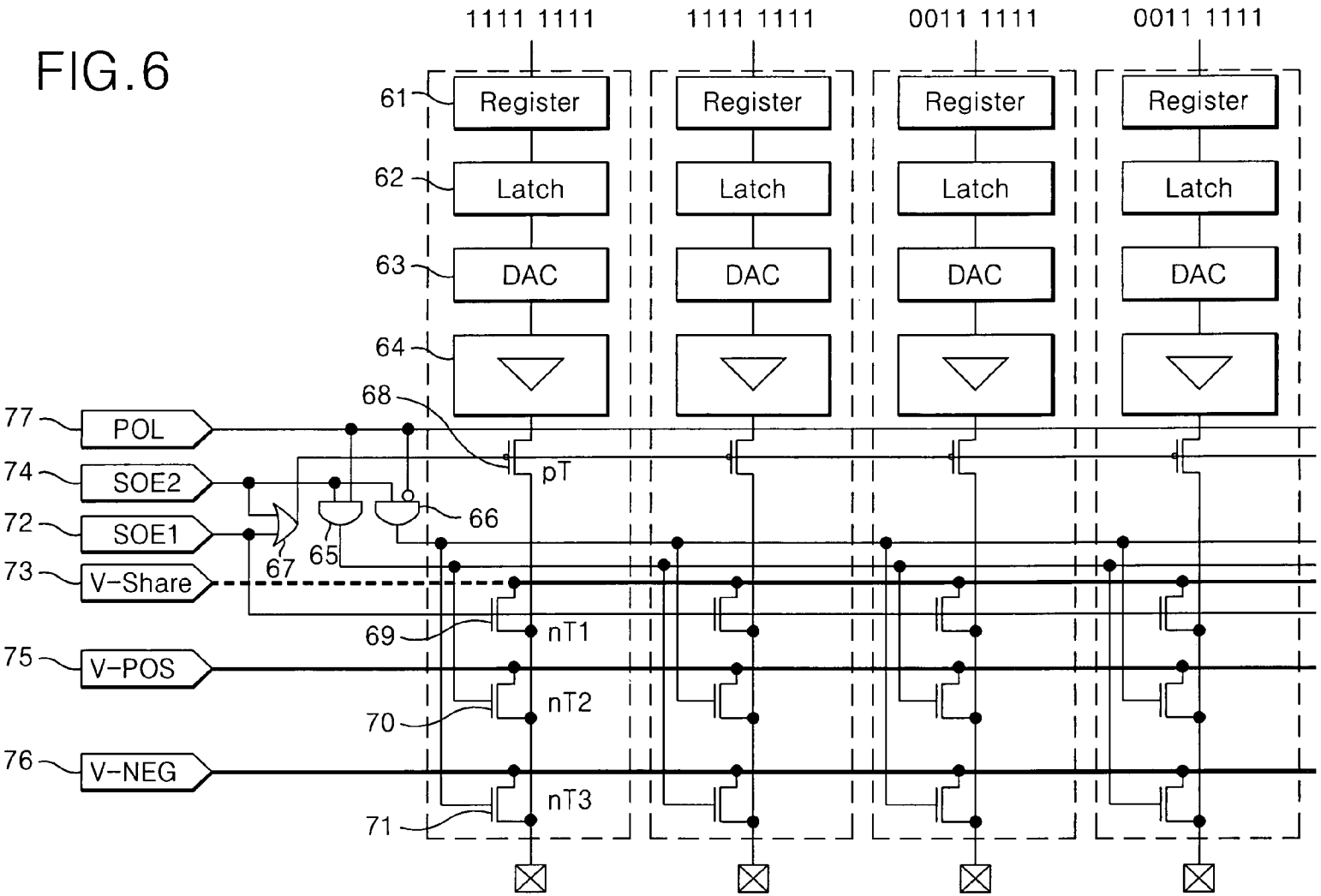
FIG. 6 is a circuit diagram illustrating an embodiment of an analog sampling device of a liquid crystal display device.
Figure 7:
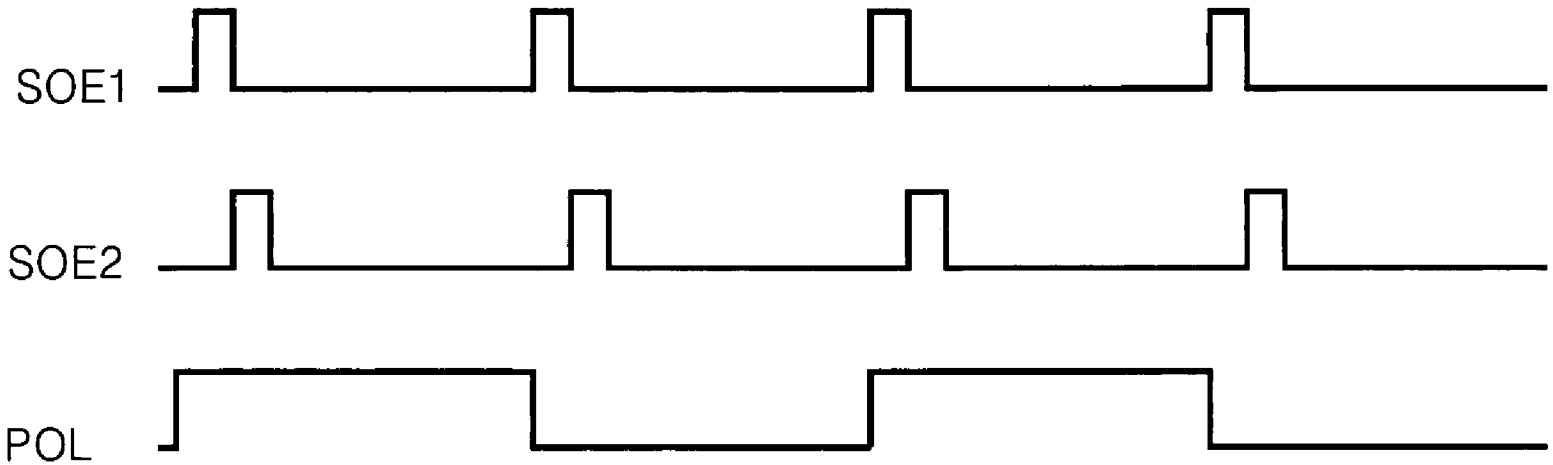
FIG. 7 is a waveform diagram illustrating source output enable signals and a polarity control signal of FIG. 6.

FIG. 6 is a circuit diagram showing an embodiment of a circuit configuration of a data IC of a liquid crystal display device. FIG. 7 is a waveform diagram showing waveforms of source output enable signals SOE1, SOE2 and a polarity control signal POL shown in FIG. 6.

Referring to FIGS. 6 and 7, a data IC of a liquid crystal display device includes a data register 61, a latch 62, a DAC 63, an output buffer 64, AND gates 65, 66, an OR gate 67, and transistors pT 68, nT1 69, nT2 70, and nT3 71.

In FIG. 7, a first source output enable signal SOE1 72 is a control signal which directs an output of a charge share voltage V-Share 73, and a second source output enable signal SOE2 74 is a control signal which directs an output of pre-charge voltages V-POS 75, V-NEG 76. The second source output enable signal SOE2 74 is shifted by one pulse width of the first source output enable signal SOE1 72. The source output enable signals SOE1 72, SOE2 74 are generated every one horizontal period. The polarity control signal POL 77 has its logic value inverted for each one horizontal period to control the polarity of the data voltage supplied to the data lines of the liquid crystal display panel. The source output enable signals SOE1 72, SOE2 74 and the polarity control signal POL 77 are generated in a timing controller.

The data register 61 supplies the digital data from the timing controller to the latch 62. The latch 62 sequentially samples and latches the digital data from the data register 61 in response to a sampling signal sequentially inputted from a shift register (not shown), and then the data register 61 outputs them at the same time to convert a series structure of the data into a parallel structure. The DAC 63 converts the data from the latch 62 into an analog gamma voltage. The output buffer 64 supplies the analog gamma voltage from the DAC 63 to a drain terminal of a p-type transistor pT 68 without loss.

The first source output enable signal SOE1 72 controls a first n-type transistor nT1 69 to pre-charge the data line of the liquid crystal display panel with the charge share voltage V-Share 73 before the pre-charge voltages V-POS 75, and V-NEG 76.

The first source output enable signal SOE1 72 is supplied to a gate terminal of the first n-type transistor nT1 69. Moreover, a drain terminal of the first n-type transistor nT1 69 is connected to the charge share voltage V-Share 73, and a source terminal is connected to the data line of the liquid crystal display panel through the output terminal of the data IC. The first n-type transistor nT1 69 supplies the charge share voltage V-Share 73 to the data line of the liquid crystal display panel in response to the first source output enable signal SOE1 72.

The OR gate 67 generates an output signal by performing a logic OR operation on the first source output enable signal SOE1 72 and the second source output enable signal SOE2 74, and controls the p-type transistor pT 68 via the second source output signal.

A gate terminal of the p-type transistor pT 68 is connected to an output terminal of the OR gate 67 and a drain terminal is connected to an output terminal of the output buffer 64. Moreover, a source terminal of the p-type transistor pT 68 is connected to the data line of the liquid crystal display panel through the output terminal of the data IC. The p-type transistor pT 68 supplies the data voltage from the output buffer 64 to the data line of the liquid crystal display panel in response to the output of the OR gate 67.

The second source output enable signal SOE2 74 is supplied to a first input terminal of the first AND gate 65 and the polarity control signal POL 77 is supplied to a second input terminal of the first AND gate 65. The first AND gate 65 performs a logic AND operation on the second source output enable signal SOE2 74 and the polarity control signal POL 77 to control the second n-type transistor nT2 70.

A gate terminal of the second n-type transistor nT2 70 is connected to an output terminal of the first AND gate 65 and a drain terminal is connected to the positive pre-charge voltage V-POS 75. Moreover, a source terminal of a second n-type transistor nT2 70 is connected to the data line of the liquid crystal display panel through the output terminal of the data IC. The second n-type transistor nT2 70 supplies the positive pre-charge voltage V-POS to the data line of the liquid crystal display panel in response to the output of the first AND gate 65.

The second source output enable signal SOE2 74 is supplied to a first input terminal of the second AND gate 66 and the polarity control signal POL 77 is supplied to a second input terminal of the second AND gate 66. The first input terminal is a non-inversion input terminal and the second input terminal is an inversion input terminal. The second AND gate 66 performs a logic AND operation on the second source output enable signal SOE2 74 and the inverted polarity control signal POL 77 to control the third n-type transistor nT3 71.

A gate terminal of the third n-type transistor nT3 71 is connected to an output terminal of the second AND gate 66 and a drain terminal is connected to the negative pre-charge voltage V-NEG 76. A source terminal of the third n-type transistor nT3 71 is connected to the data line of the liquid crystal display panel through the output terminal of the data IC. The third n-type transistor nT3 71 supplies the negative pre-charge voltage V-NEG 76 to the data line of the liquid crystal display panel in response to the output of the second AND gate 66.

Moreover, the charge share voltage V-Share 73 can be separately generated in a power supply circuit which is arranged in the outside of the data IC, and might be a voltage which is generated by the charge share of the data lines within the data IC. The charge share voltage V-Share 73 can be divided into more than two voltages within a range of voltage which is lower than the positive pre-charge voltage V-POS 75 and higher than the negative pre-charge voltage V-NEG 76.

Figure 8:
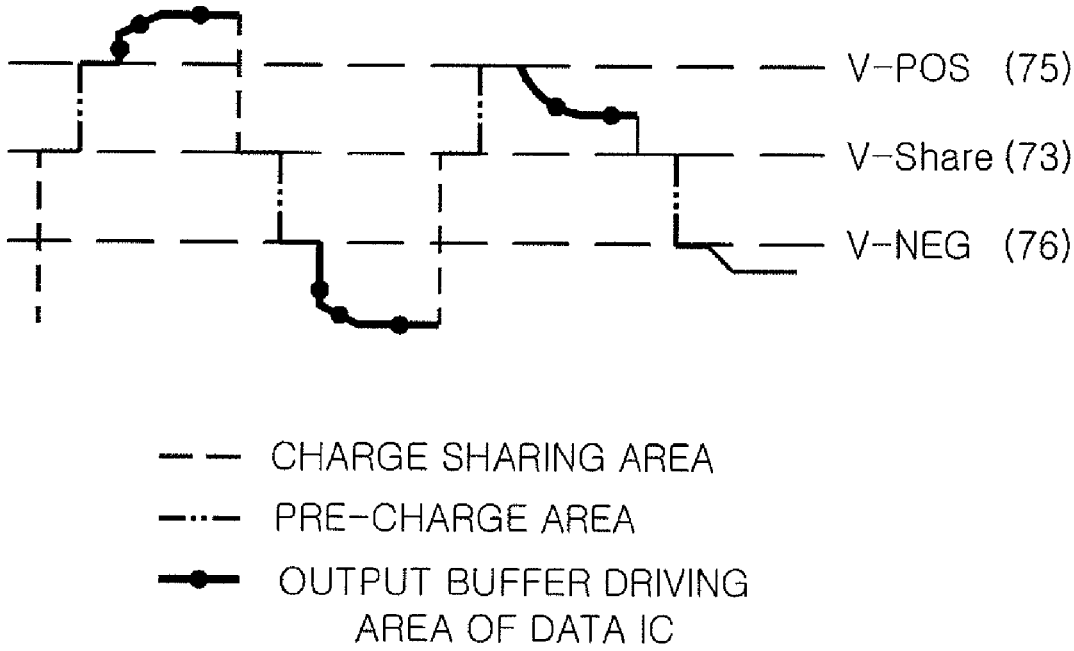
FIG. 8 is a waveform diagram illustrating one example of a waveform outputted from a data integrated circuit of a liquid crystal display device according to the embodiment of FIG. 6.

The data IC of the liquid crystal display device, as shown in FIG. 8, first pre-charges the data line of the liquid crystal display panel with the charge share voltage V-Share 73 in accordance with the first source output enable signal SOE1, then second pre-charges the data line with the pre-charge voltages V-POS 75, and V-NEG 76 in accordance with the second source output enable signal SOE2, and then supplies the data voltage to the data line. As such, the data IC can reduce the generated heat temperature of the data IC by decreasing the operation section of the output buffer 64, as shown in FIG. 8.

As described above, the liquid crystal display device, and the driving method thereof, first pre-charges the data line with the charge share voltage, then second pre-charges the data line with the pre-charge voltage which is higher than the charge share voltage to reduce the operation of the output buffer, thereby lowering the generated heat temperature of the data IC and enabling to reduce power consumption.

Although the present invention has been described by the embodiments shown in the drawings described above, it should be understood to an ordinary skilled person in the art that the invention is not limited to the embodiments, but rather that various changes or modifications thereof are possible without departing from the spirit of the invention. Accordingly, the scope of the present embodiments shall be determined only by the appended claims and their equivalents.

What is claimed is:

1. A liquid crystal display device, comprising:

a first transistor that outputs a charge share voltage to a data line in response to a first output control signal;

a logic circuit that outputs first to third output signals in response to the first output control signal, a second output control signal and a polarity control signal, wherein the second output control signal is phase-shifted from the first output control signal and the polarity control signal controls a polarity of a data signal;

a second transistor that outputs a positive pre-charge voltage, which is greater than the charge share voltage, to the data line in response to the first output signal;

a third transistor that outputs a negative pre-charge voltage, which is lower than the charge share voltage, the data line in response to the second output signal; and a fourth transistor that outputs the data voltage to the data line in response to the third output signal.

2. The liquid crystal display device according to claim 1, wherein the first transistor includes:

a first n-type transistor which is controlled by the first source output signal, wherein the second transistor includes:

a second n-type transistor that outputs the positive pre-charge voltage to the data line in response to the first output signal when the polarity of the data voltage is positive;

wherein the third transistor includes:

a third n-type transistor that outputs the negative pre-charge voltage to the data line in response to the second output signal when the polarity of the data voltage is negative; and wherein the fourth transistor includes:

a fourth p-type transistor that outputs the data voltage to the data line in response to the third output signal.

3. The liquid crystal display device according to claim 2, wherein the logic circuit includes:

an OR gate that controls the fourth p-type transistor by performing a logic OR operation on the first and second output control signals;

a first AND gate that controls the second n-type transistor by performing a logic AND operation on the second output control signal and the polarity control signal; and a second AND gate that controls the third n-type transistor by performing a logic AND operation on the second output control signal and a inverted polarity control signal, wherein the inverted polarity control signal is inverted from the polarity control signal.

4. The liquid crystal display device according to claim 1, wherein the second source output signal is shifted by one pulse width of the first output signal.

5. The liquid crystal display device according to claim 1, wherein the first and second output control signals are periodically generated every one horizontal period.

6. The liquid crystal display device according to claim 1, wherein the polarity control signal has a logic value inverted for each one horizontal period to control the polarity of the data voltage supplied to the data lines of the liquid crystal display panel.

7. The liquid crystal display device according to claim 1, wherein the output control signals and the polarity control signal are generated by a timing controller.

8. A liquid crystal display device, comprising:

a first n-type transistor which is controlled by a first output control signal and outputs a charge share voltage to a data line in response to the first output control signal;

a first AND pate that outputs a first output signal by performing a logic AND operation on a second output control signal and a polarity control signal, wherein the second output control signal is phase-shifted from the first output control signal and the polarity control signal controls a polarity of a data signal;

a second n-type transistor that outputs a positive pre-charge voltage, which is greater than the charge share voltage, to the data line in response to the first output signal when a polarity of a data voltage is positive;

a second AND gate that outputs a second output signal by performing a logic AND operation on the second output control signal and a inverted polarity control signal, wherein the inverted polarity control signal is inverted from the polarity control signal;

a third n-type transistor that outputs a negative pre-charge voltage, which is lower than the charge share voltage, to the data line in response to the second output signal when the polarity of the data voltage is negative;

an OR gate that outputs a third output signal by performing a logic OR operation on the first and second output control signals; and a p-type transistor that supplies the data voltage to the data line of a liquid crystal display panel in response to the third output signal.

9. A method for driving a liquid crystal display device, the method comprising:

supplying a charge share voltage to a data line in response to a first output control signal;

outputting a first output signal by performing a logic AND operation on a second output control signal and a polarity control signal, wherein the second output control signal is phase-shifted from the first output control signal and the polarity control signal controls a polarity of a data signal;

supplying a positive pre-charge voltage, which is greater than the charge share voltage, to the data line in response to the first output signal when a polarity of a data voltage is positive;

outputting a second output signal by performing a logic OR operation on the first and second output control signals;

supplying the data voltage to the data line in response to the second output signal;

outputting a third output signal by performing a logic AND operation on the second output control signal and a inverted polarity control signal, wherein the inverted polarity control signal is inverted from the polarity control signal; and supplying a negative pre-charge voltage, which is lower than the charge share voltage, to the data line in response to the third output signal when the polarity of the data voltage is negative.

10. The method of claim 9, wherein the charge share voltage is supplied via a first transistor.

11. The method of claim 9, wherein the positive pre-charge share voltage is supplied via a second transistor.

12. The method of claim 9, wherein the data voltage is supplied via a third transistor.

13. The method of claim 9, wherein the negative pre-charge share voltage is supplied via a fourth transistor.

* * * * *

UNITED STATES PATENT AND TRADEMARK OFFICE

CERTIFICATE OF CORRECTION

PATENT NO. : 7,570,243 B2
APPLICATION NO. : 11/295975
DATED : August 4, 2009
INVENTOR(S) : Sin Ho Kang et al.

It is certified that error appears in the above-identified patent and that said Letters Patent is hereby corrected as shown below:

In column 7, claim 8, line 19, after "a first AND" replace "pate" with --gate--.

Signed and Sealed this

Twenty-ninth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,570,243 B2
APPLICATION NO. : 11/295975
DATED : August 4, 2009
INVENTOR(S) : Kang et al.

It is certified that error appears in the above-identified patent and that said Letters Patent is hereby corrected as shown below:

On the Title Page

Item [*] Notice: Subject to any disclaimer, the term of this patent is extended or adjusted under 35 USC 154(b) by 675 days.

Delete the phrase "by 675 days" and insert -- by 909 days --

Signed and Sealed this

Twenty-seventh Day of April, 2010

David J. Kappos

David J. Kappos
*Director of the United States Patent and Trademark Office*